US008650844B2

(12) United States Patent
Romanyszyn et al.

(10) Patent No.: US 8,650,844 B2
(45) Date of Patent: Feb. 18, 2014

(54) METHOD AND APPARATUS FOR A PRODUCT DISPENSER

(76) Inventors: Michael T. Romanyszyn, San Antonio, TX (US); Thomas J. Chadwell, San Antonio, TX (US); John Vira, Lockhart, TX (US)

( * ) Notice: Subject to any disclaimer, the term of this patent is extended or adjusted under 35 U.S.C. 154(b) by 473 days.

(21) Appl. No.: 12/927,146

(22) Filed: Nov. 8, 2010

(65) Prior Publication Data

US 2012/0110948 A1 May 10, 2012

(51) Int. Cl.
*B65B 31/00* (2006.01)

(52) U.S. Cl.
USPC ..... 53/512; 53/440; 53/502; 53/127; 53/284.7

(58) Field of Classification Search
USPC ..... 53/428, 467–469, 502, 111 R, 512, 127, 53/266.1, 284.7, 440
See application file for complete search history.

(56) References Cited

U.S. PATENT DOCUMENTS 4,250,688 A * 2/1981 Lingenfelder ..... 53/438
5,088,300 A * 2/1992 Wessa ..... 62/340
5,277,016 A * 1/1994 Williams et al. ..... 53/459
6,474,048 B1 * 11/2002 Metzger et al. ..... 53/493
7,104,291 B2 * 9/2006 Dalton et al. ..... 141/82
7,958,918 B2 * 6/2011 Ladson ..... 141/114
2007/0175235 A1 * 8/2007 Metzger ..... 62/344
2007/0209330 A1 * 9/2007 Metzger ..... 53/469
2008/0283145 A1 * 11/2008 Maxwell ..... 141/114

* cited by examiner

*Primary Examiner* — Christopher Harmon
(74) *Attorney, Agent, or Firm* — John Vira

(57) ABSTRACT

A product dispenser includes an outer housing and a shell disposed within the outer housing. The shell defines a product dispensing chamber, wherein the product dispensing chamber is climate controlled, for receiving a product, portioning the product, storing the portioned product, and dispensing the portioned product upon a dispense command. The product receptacles are stored in a dispense buffer disposed within the product dispensing chamber, and then are dispensed into an airlock for retrieval by a customer. The product dispenser further recognizes demands to keep the dispense buffer slots filled, and demands to dispense a filled product receptacle. The product dispenser may seal the product receptacles to ensure a sanitary product. The product dispenser may further include a vend interface unit to interact with a controller and consumers, whereby the consumer are able to place a demand on the vend interface unit, and await a dispensed filled product receptacle.

19 Claims, 15 Drawing Sheets

METHOD AND APPARATUS FOR A PRODUCT DISPENSER

BACKGROUND OF THE INVENTION

1. Field of the Invention

The present invention relates to product dispensing equipment and, more particularly, but not by way of limitation, to methods and an apparatus for generation, storage, and dispensing of a stored product in a product dispenser.

2. Description of the Related Art

In the areas of ice vending, either in-store or in a self-contained remote bagging unit, ice generation machines are placed on top of ice bagging machines disposed in an ambient environment to capture the ice product, and bag a predetermined portion of the ice dispensed by the ice generation device. While attempts have been made to remove water from the ice generation system, a fair amount of water finds its way into the bag. The setup still further includes a merchandiser disposed beneath the bagging machine to hold the sealed bags of ice.

Problems arise because the ice bags dropped into the merchandiser do not organize themselves upon falling into the merchandiser, and the merchandiser ends up in disarray. The water in the bag then freezes in whatever orientation the bag is laying, thereby forcing the store workers to reorganize the merchandiser and strike the frozen bags with a mallet to break up the frozen block. Occasionally, the customers break up the ice block on the lower threshold of the merchandiser doorway when they retrieve their bag of ice.

In remote bagger situations, large amounts of ice must be stored and agitated to prevent the ice awaiting bagging from freezing together. Once the ice commences freezing together, use of the agitator to break up the frozen together cubes, actually cracks, or crushes the ice cubes, and creates non-uniform cube shapes.

Still further, the vending of bulk ice down an exposed chute is by no means sanitary, because the chute is exposed to an ambient environment at a temperature range between below freezing to above one hundred degrees Fahrenheit, which most likely includes airborne microbes, mold, and the like.

Accordingly, an expandable ice generation, buffer storage, and dispensing system that produces sanitary product bags that contain minimal amounts of water, stores the bagged product in an orderly fashion, and dispenses the bagged product is desirable to ice dispensing corporations, owners of the dispensing points, and the customers desiring to purchase sanitary ice from a retail outlet.

SUMMARY OF THE INVENTION

In accordance with the present invention, a product dispenser dispenses sealed product receptacles from a dispense buffer disposed within a shell defining a product dispensing chamber. The product dispensing chamber is climate controlled to maintain an optimum environment inside the product dispensing chamber. The dispense buffer includes locations in a dispense bank, wherein the locations are designated for storage or for loading a product receptacle. The dispense buffer may include a plurality of dispense banks for increased storage. The product dispenser may be utilized as a stand-alone unit, whereby consumers approach a vend interface unit, and conduct a monetary transaction to purchase a sealed product receptacle.

The product dispenser further includes an airlock to minimize the thermal disruption of the product dispensing chamber due to opening doors, and the like. The airlock further includes an airlock outlet, whereby a consumer opens the airlock outlet to retrieve a purchased product receptacle.

It is therefore an object of the present invention to provide a product dispenser comprising a shell defining a product dispensing chamber, wherein the product receptacle is opened, filled, and stored in a sanitary environment.

It is a further object of the present invention to provide a dispense buffer for storing filled product receptacles and dispensing the filled product receptacle upon a demand.

It is still further an object of the present invention to provide a product receptacle opening apparatus including dual circuits and notifications associated therewith.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

Figure 1A:
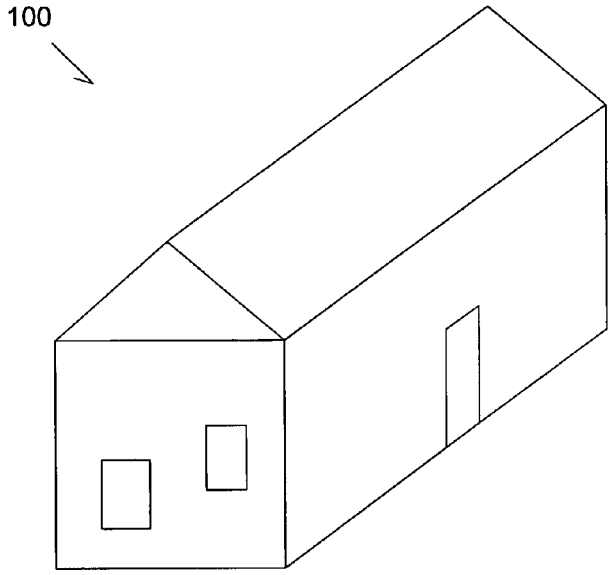
FIG. 1*a* provides an isometric view of a product dispenser according to the preferred embodiment.
Figure 1B:
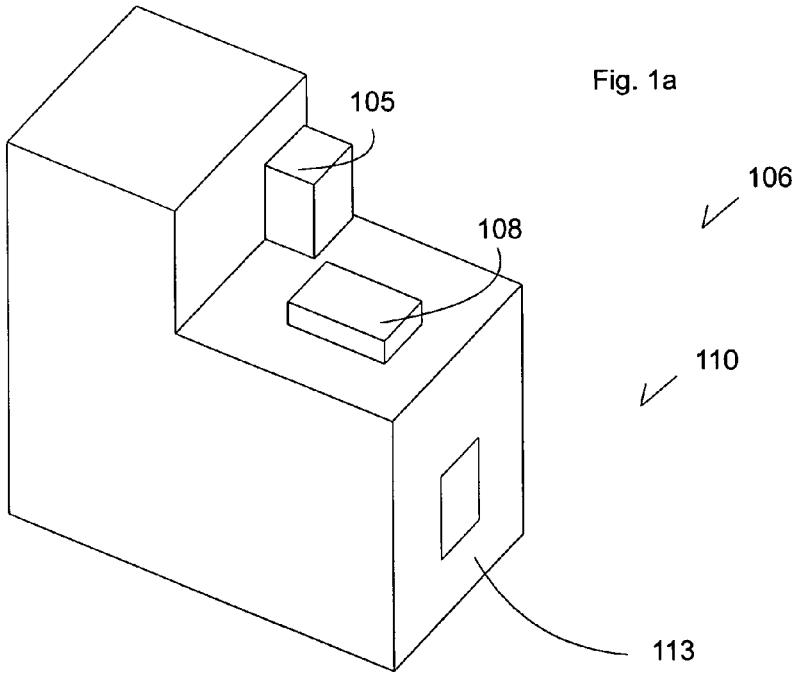
FIG. 1*b* provides a perspective view of a shell according to the preferred embodiment.
Figure 1C:
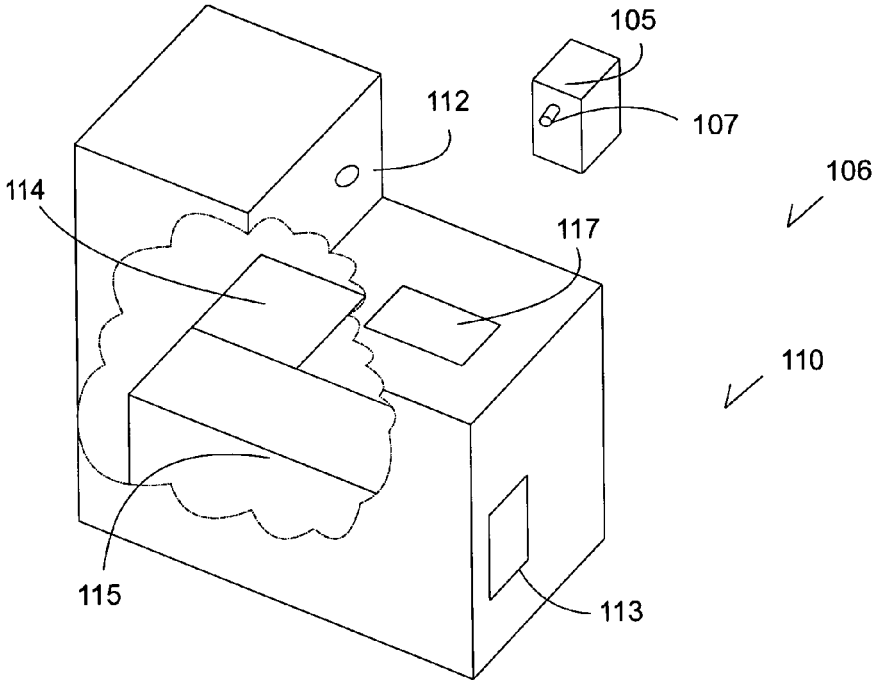
FIG. 1*c* provides cutaway view of the shell according to the preferred embodiment.
Figure 1D:
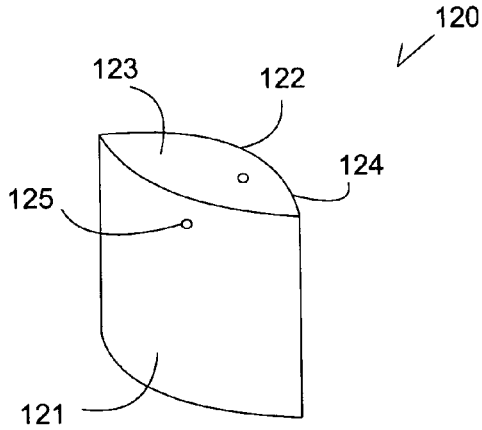
FIG. 1*d* provides a perspective view of a product receptacle according to the preferred embodiment.

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

In a simplest embodiment, a product dispenser 100 includes and a shell 106 defining a product dispensing chamber 110, and at least one product source 111. The shell 106 may formed from a variety of materials having insulating qualities, either individually, or in combination, such as urethane foams in combination with sheet-metal extrusions to create rigid panels. Alternatively, the shell 106 may be formed from lighter gauge materials if an outer housing is utilized to protect the shell 106 and the contents disposed within product dispensing chamber 110. The cavity disposed within the shell 106 is the product dispensing chamber 110, and, in this particular example, the shell 106 includes an environmental control system 108 to keep the product dispensing chamber 110 at a desired temperature, dependent upon product requirements. In cases of frozen products, such as ice, the product dispensing chamber 110 is held below freezing. While this particular example of the simplest embodiment has been shown with a product dispensing chamber 110 having a temperature below freezing, one of ordinary skill in the art will recognize that product dispensing chambers may be maintained at virtually any temperature, dependent upon the type of product disposed in the product dispensing chamber 110, and, therefore, should be construed as being within the scope of this invention.

Figure 2A:
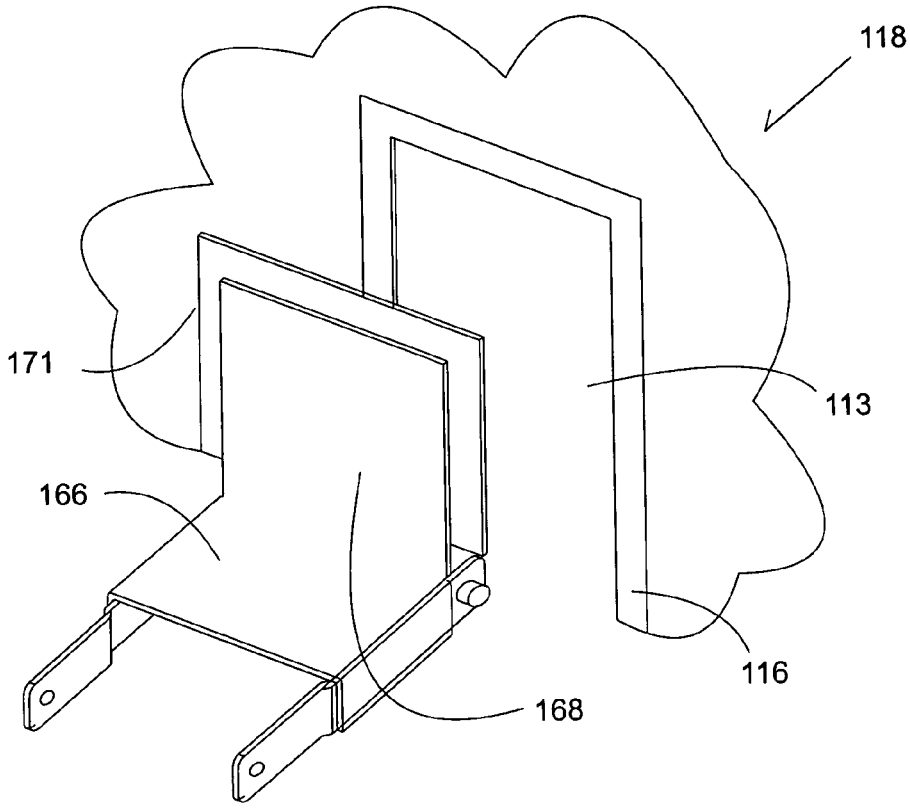
FIG. 2*a* provides a perspective view of the belt segment and an outlet port seal according to the preferred embodiment.

The shell 106 includes an inlet port 112 leading to the product dispensing chamber 110 and an outlet port 113 for the delivery of product from the product dispensing chamber 110. The inlet port 112 is complementary in size to an outlet 107 of the product source 111, such that any product generated is dispensed directly into the inlet port 112 of the product dispensing chamber 110. The outlet port 113 is of a predetermined size, and includes a closeout device 118 to keep treated air from escaping through the outlet port 113. In this particular example, as shown in FIG. 2*a*, the closeout device 118 is a seal flange 171 and a seal 116 that mate to create a thermal barrier. However, one of ordinary skill in the art will recognize that other forms of doors or panels may be utilized to provide access to an inner portion of the product dispensing chamber 110 and to maintain the environmental conditions of the product dispensing chamber 110, dependent upon the specific applications of this invention.

The shell 106 further includes an environmental control port 117 for adapting to the environmental control unit 108. In this simplest embodiment, the environmental control port 117 is disposed in an upper area of the shell 106.

In this disclosure, the term product source 111 is defined as virtually any form of product delivery apparatus, whereby a product is output directly, or may be treated to overcome deficiencies of the product. In this particular example, the product is ice, and, accordingly, the product source 111 may include a product generator 105.

In this disclosure, the term product generator 105 may be defined as virtually any form of ice generating equipment, whereby the ice is delivered in any type of cube form, such as square, cylindrical, pellet, concave, convex, dome, or hollow derivatives thereof. In this invention, the product generator 105 may generate virtually any form of ice cubes for delivery through the outlet 107. In this particular example, the product generator 105 is an extruded ice generator that delivers cylindrical cubes through a circular outlet.

The product dispenser 100 further includes a portioning station 114 disposed within the product dispensing chamber 110. The portioning station 114 includes a means for segmenting a predetermined amount of product dispensed from the product source 111. Often, a product receptacle 120 having a chamber 123 therein is utilized to contain the predetermined amount of the product.

In this disclosure, the term product receptacle 120 may be defined as any form of packaging, such as plastic bags, containers, or the like, for receiving a portioned product, such as ice. The product receptacle 120 generally includes two sides and an opening leading to the chamber for receiving a product. While this product receptacle has been defined as a plastic bag, one of ordinary skill in the art will recognize that product receptacles may be delivered in a variety of ways, including rolls, stacks, or individually, and virtually any form of product receptacle may be utilized with this invention. One of ordinary skill in the art will further recognize product receptacles may be formed in shapes other than plastic bags having two sides, and that product receptacles may additionally be formed in place for individual use, pulled from a stack, or unrolled from a roll of product receptacles, and this invention may be adapted to each of these forms. In this particular example, the product receptacle 120 includes a first side 121, a second side 122, and a fill port 124 leading to the chamber 123. The product receptacle 120 further includes at least one hanging aperture 125 for receiving a hanger bracket 127, whereby a stack 151 of product receptacles 120 may hang on the hanger bracket 127 while awaiting use.

The portioning station 114 includes a metering apparatus 130, an opening apparatus 131, a sealing apparatus 134, and an ejection apparatus 132. The metering apparatus 130 may be any form of portioning device known in the industry to meter or segment predetermined portions of the product, such as weighing. In this specific example of the simplest embodiment, the metering apparatus 130 includes a scale 135, a scale support frame 136, and a scale locking device 137, whereby the scale support frame 136 is secured to structure disposed within the product dispensing chamber 110, and supports the scale 135 in a position to perform weighing operations. In this simplest embodiment, the scale 135 is disposed substantially directly beneath the inlet port 112 of the shell 106, and, therefore, receives the product entering through the inlet port 112. The scale locking device 137 has a first position for preventing the scale 135 from weighing, and a second position for weighing, whereby the scale 135 is free to move downward during the weighing operation. While this specific example has been shown utilizing a scale, one of ordinary skill in the art will recognize that load cells may be employed as the portioning devices, with minimal movement of the scale.

Figure 1E:
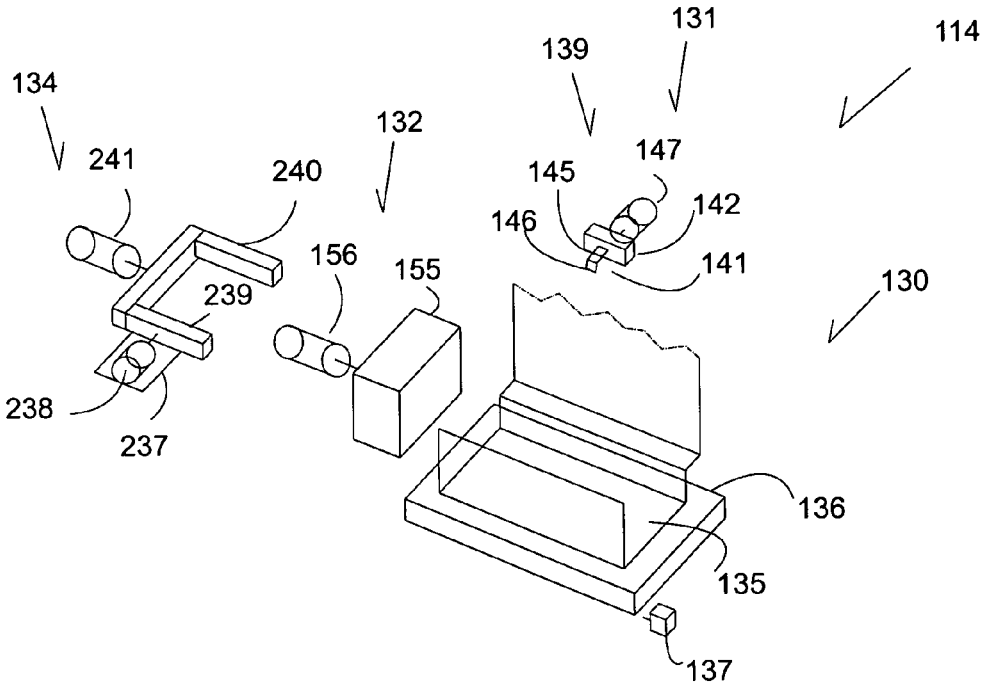
FIG. 1*e* provides a perspective view of a portioning station according to the preferred embodiment.
Figure 1G:
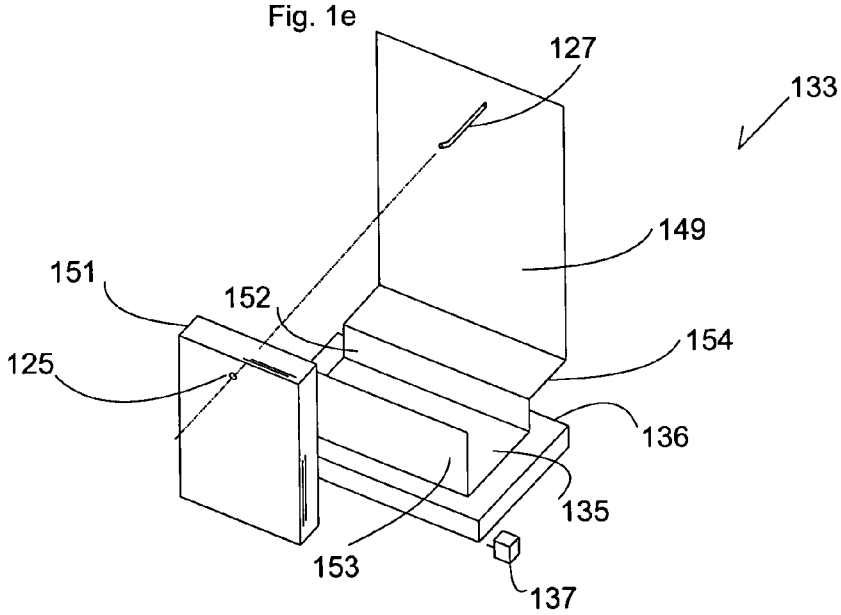
FIG. 1*g* provides a perspective view of a staging area of the portioning station according to the preferred embodiment.
Figure 1F:
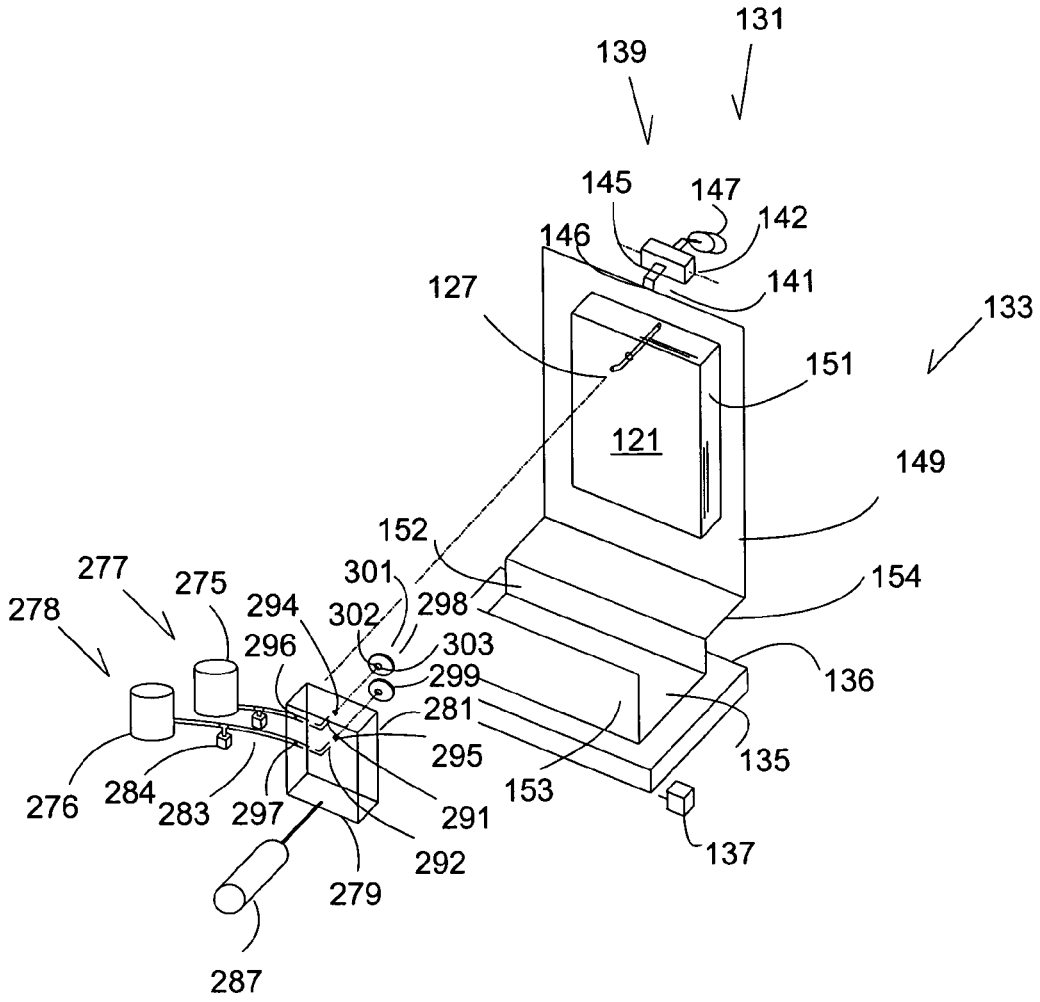
FIG. 1*f* provides a perspective view of an opening apparatus of the portioning station according to the preferred embodiment.
Figure 1H:
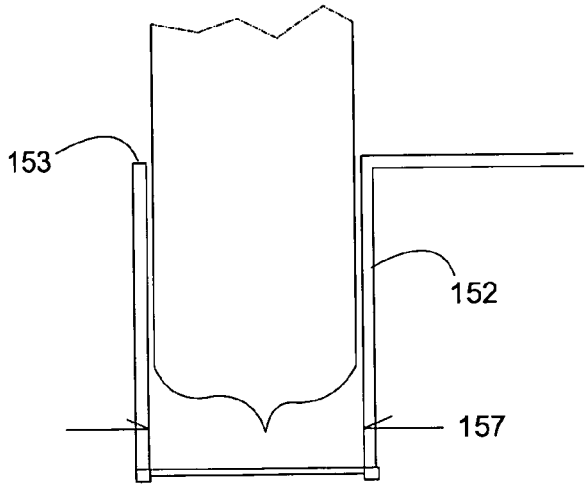
FIG. 1*h* provides a side view of the portioning station according to the preferred embodiment.
Figure 1I:
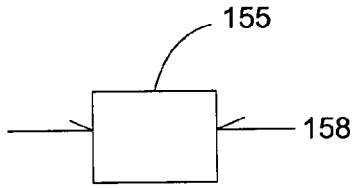
FIG. 1*i* provides a side view of an ejection device according to the preferred embodiment.

The opening apparatus 131 pulls on at least one side of the product receptacle 120 to open the product receptacle 120. In this particular example of the preferred embodiment, the opening apparatus 131 is a dual-circuit vacuum grasping system. As shown in FIG. 1*f*, the opening apparatus 131 includes substantially identical vacuum circuits. The opening apparatus 131 includes a vacuum block 279, first and second vacuum sources 275-276, and first and second sensors 283-284. The vacuum block 279 includes a first suction passage 291 between first and third ports 294 and 296, a second vacuum passage 292 between second and fourth ports 295 and 297, and suction surface 281, wherein the first and second ports 294 and 295 are disposed on the suction surface 281. The vacuum block 279 may be formed from virtually any machinable material, such as aluminum. The vacuum sensors 283-284 may be virtually any form of vacuum sensor, whereby the sensor senses the presence or lack of a predetermined vacuum level, and generates a signal therefrom. The opening apparatus 131 further includes a driver 287 connected to the vacuum block 279, wherein the driver 287 extends and retracts to move the vacuum block 279 toward and away from a stack of product receptacles 120, such that the vacuum block 279 moves from a first position to a second position to attach to the first side 121 of the product receptacle 120, and from the second position to the first position to pull the first side 121 of the product receptacle 120 away from the second side 122 of the product receptacle 120. While this particular embodiment has been shown to move from a first position to a second position, one of ordinary skill in the art will recognize that any increment therebetween is possible, and, therefore, additional stops may be utilized to accomplish other desired tasks.

The opening apparatus 131 may further include a vacuum aid at each suction port to promote suction and sealing off on an adjacent object. In this particular case, a first vacuum aid 298 is disposed at the first port 294 and a second vacuum aid 299 is disposed at the second port 295. In this particular example, the vacuum aids are suction cups having an inlet 301, an outlet 302, and an aperture 303 therethrough. The outlet 302 is adaptable to the first port 294 and the second port 295 to promote sealing when the inlet 301 comes into contact with a smooth surface. The vacuum aids are formed from a pliable material, such as silicone. In the cases utilizing a vacuum aid 297, the suction surface 281 moves to the inlet 301, or broadest portion, of the suction cup. Accordingly, the opening apparatus 131 may be utilized with or without the vacuum aids 297-298.

A first vacuum circuit 277 includes the first vacuum source 275, a vacuum line passing from an inlet of the first vacuum source 275 to the third port 296 of the vacuum block 279, and a first vacuum sensor 283 connected between the first vacuum source 275 and the vacuum block 279, whereby the first vacuum sensor 283 reads the vacuum of the first vacuum circuit 277. A second vacuum circuit 278 includes the second vacuum source 276, a vacuum line passing from an inlet of the second vacuum source 276 to the fourth port 297 of the vacuum block 279, and the second vacuum sensor 284 connected between the second vacuum source 276 and the vacuum block 279, whereby the second vacuum sensor 284 reads the vacuum of the second vacuum circuit 278. The vacuum sources 275-276 may be virtually any device or system that generates a vacuum, and is adaptable to the vacuum circuits described.

The opening apparatus 131 further includes a restraint device 139 to hold the second side 122 of a product receptacle 120 being opened. As shown in FIG. 1*f*, the restraint device 139 includes a restraint bar 141 disposed on a restraint bar frame 142. In this particular example, the restraint bar 141 further includes a base portion 145 and an extensor portion 146 angled downward for applying pressure to an inner portion of one side of the product receptacle 120. In this preferred embodiment, the restraint bar 141 is formed from a food-grade material, such as stainless steel. The restraint bar frame 142 is attached to a second driver 147 that extends to rotate the restraint bar frame 142 from a horizontal position to an angled position, thereby pushing the restraint bar 141 downward to engage the second side 122 of the product receptacle 120.

In this simplest embodiment, the restraint bar frame 142 is rotatably fastened to the scale support frame 136, and is disposed parallel to and directly across from the vacuum block 279 to oppose the pulling action of the vacuum opening system. While this specific example of the first embodiment has been described with a restraint device 139 having a restraint bar 141, one of ordinary skill in the art will recognize that virtually any form of restraint device may be utilized to restrain the second side of the product receptacle 120 being opened, including restraint devices having hooks, suction cups, or the like.

The portioning station 114 further includes a staging apparatus 133 for orienting product receptacles 120, or a roll of product receptacles, or other form of product receptacles, for use. As shown in FIG. 1*f*, in this particular example of the simplest embodiment, the staging apparatus 133 includes a support plate 149 having an offset 154 and the hanger bracket 127. As shown, the support plate 149 is adaptable to the scale support frame 136 and is disposed substantially perpendicular to the scale support frame 136. In this configuration, the staging apparatus 133 is capable of supporting a plurality of product receptacles 120 disposed in a stack. Each product receptacle 120 includes at least one hanging aperture 125, whereby a plurality of product receptacles 120 are disposed in a stack 151, and the hanger bracket 127 passes through the aligned hanging apertures 125 to store the plurality of product receptacles 120 for usage, one product receptacle 120 at a time. While this particular example has been shown with only one hanging aperture 125 utilized in combination with a single hanger bracket 127, one of ordinary skill in the art will recognize that the other quantities of hanging apertures 125 and hanger brackets 127 are possible, and, therefore, should be construed as part of this invention. One of ordinary skill in the art will further recognize that various forms of product receptacles may be utilized, including plastic bags on a roll, form fill and seal bags, and the like. One of ordinary skill in the art will still further recognize that the other forms of product receptacles may be utilized with this invention by modifying the staging apparatus to conform to a particular form of product receptacle.

The portioning station 114 may further include a first width guide plate 152 and a second width guide plate 153 secured to the scale support frame 136. The first and second width guide plates 152-153 are formed from virtually any material that is rigid, and extend upward away from the scale support frame 136 to keep the product receptacle 120 at a desired width during filling operations. As shown in FIG. 1*g*, in this specific example of the simplest embodiment, the first and second width guide plates 152-153 are disposed parallel to the first and second sides 121-122 of the product receptacle 120, and extend upward at least one third of a height of the product receptacle 120 being filled to keep the product receptacle 120 within a consistent desired width profile 157. In this particular example, the desired width is approximately four inches.

The sealing apparatus 134 includes a position driver 241, seal driver 238, a heat seal bar 239, a seal bar structure 237, and a seal backup bar 240. The position driver 241 is a linear driver that moves the heat seal bar 239, seal driver 238, and seal backup bar 240 into and out of a sealing position. The seal bar structure 237 adapts to an extending portion of the position driver 241, and may be formed from virtually structural material. The heat seal bar 239 may be virtually any form of heater bar for building up a heater. In this particular example, the heat seal bar 239 is formed from a machined housing surrounding at least one resistive heater. The heat seal backup bar 240 may be formed from virtually any form of structural materials, such as stainless steel sheet that may withstand the loading when the heat seal bar 239 moves into the seal backup bar 240. The seal backup bar 240 may further include an elastomeric pad to make up for mismatches in the bag level. The seal driver 238 is a linear actuator that secures to the seal bar structure 237 to move the heat seal bar 239 toward and away from the seal backup bar 240.

The ejection apparatus 132 provides for moving a filled product receptacle 119 from the metering apparatus 130 to a dispense buffer 115. In this particular example of the simplest embodiment, the ejection apparatus 132 pushes the filled product receptacle 119 off of the scale 135. As shown in FIG. 1*e*, the ejection apparatus 132 includes a pushbar 155 in combination with a pushbar driver 156. The pushbar 155 is of a width profile 158 that is less than the width profile 157 between the first and second guide plates 152-153. The pushbar 155 passes over the scale 135 to move the filled product receptacle 119 off of the scale 135, whereby the filled product receptacle 119 is pushed onto a loading slot 225 of the dispense buffer 115.

Figure 1J:
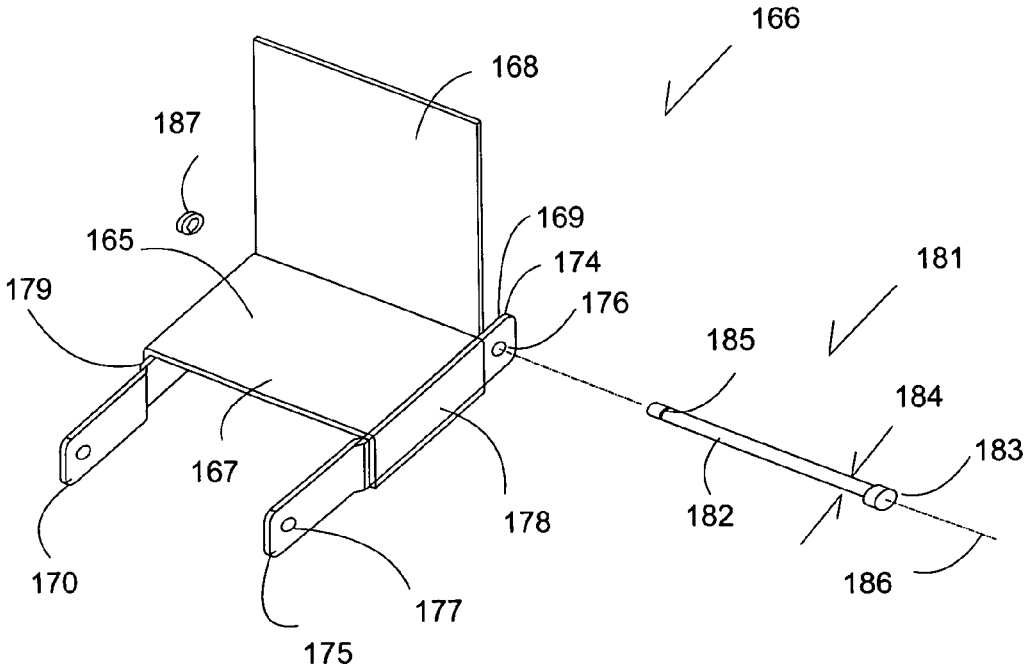
FIG. 1*j* provides a perspective view of a belt segment according to the preferred embodiment.

The dispense buffer 115 includes a conveyor belt 161 having first through tenth dispense buffer slots 226-235, the loading slot 225, a drive shaft assembly 162 to drive the conveyor belt 161, a follower shaft assembly 163 to support the conveyor belt 161 opposite the driver shaft 162, and a driver 164 to drive the drive shaft assembly 162, thereby driving the conveyor belt 161 around the shaft assemblies 162-163. The conveyor belt 161 is formed by joining multiple belt segments 166 together to form a loop. As shown in FIG. 1*j*, a belt segment 166 is formed from a first conveyor link 169, a second conveyor link 170, and a saddle 165. The saddle 165 includes a bag engagement face 167 and a rear support 168 that has a first position for supporting a product, and a second position for height reduction. As shown in FIG. 2*a*, the rear support 168 includes a seal flange 171 that extends outward from the edges of the rear support 168. The seal flange 171 is formed from a pliable material, such as an elastomer to remain flexible in a cold environment. The saddle 165 further includes a first flange 178 and a second flange 179 that extend away from the bag engagement face 167. In this particular example, the first and second flanges 178-179 are disposed substantially perpendicular to the bag engagement face 167.

The first and second conveyor links 169-170 are identical, and are disposed symmetrically. As shown in FIG. 1*j*, the first conveyor link 169 includes a primary face 174 and a secondary face 175 that are offset from each other. The primary face 174 includes a first pivot aperture 176 and the secondary face 175 includes a second pivot aperture 177. The first and second pivot apertures 176-177 are of a diameter complementary to a diameter 184 of a body 182 of a pivot pin 181, such that the pivot pin 181 may pass through the first and second pivot apertures 176-177, and the links may rotate about an axis 186 of the pivot pin 181.

The pivot pin 181 includes the body 182 and a head 183, whereby the head 183 is of a larger diameter than the body 182 to provide a stop. The pivot pin 181 also includes a pin restraint feature 185 for receiving a pin restraint 187. In this particular example, the pin restraint feature 185 is a groove, and the pin restraint 187 is an e-ring utilized in combination with a washer.

Figure 1N:
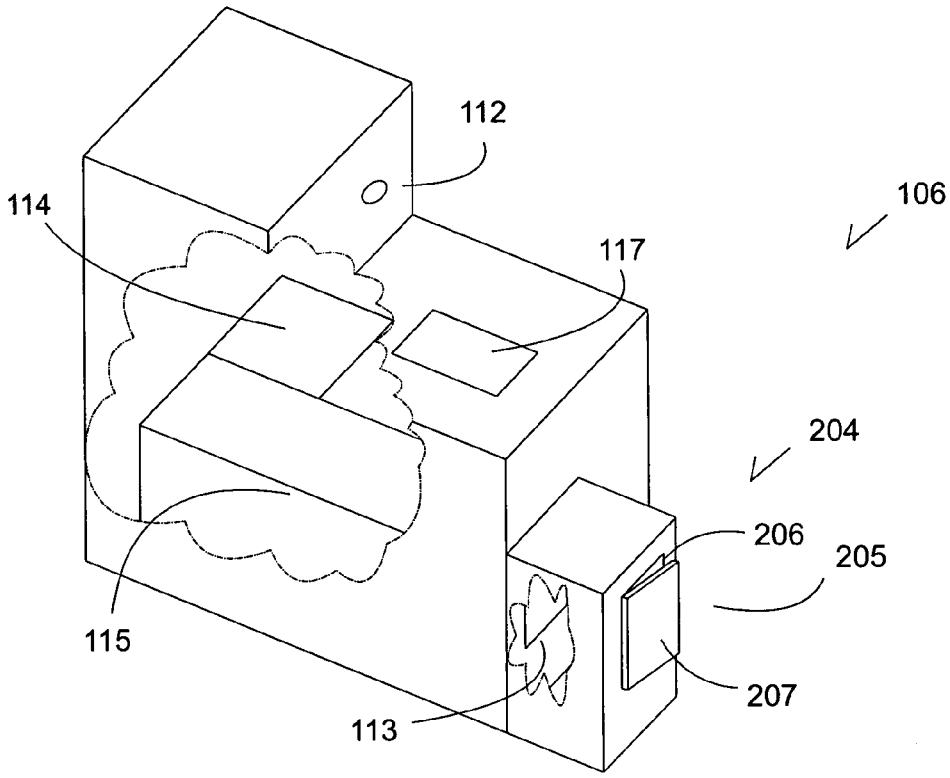
FIG. 1*n* provides a cutaway view of the shell according to the preferred embodiment.
Figure 1K:
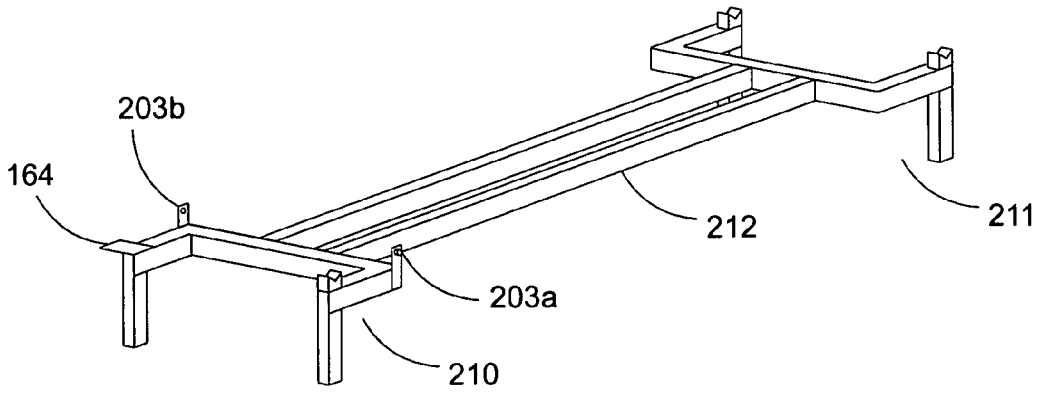
FIG. 1*k* provides a perspective view of a support frame for a dispense buffer according to the preferred embodiment.
Figure 1L:
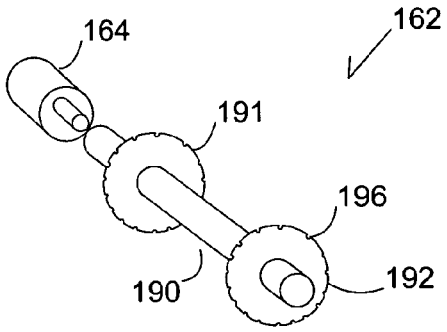
FIG. 1*l* provides a perspective view of a drive shaft assembly for the dispense buffer according to the preferred embodiment.
Figure 1M:
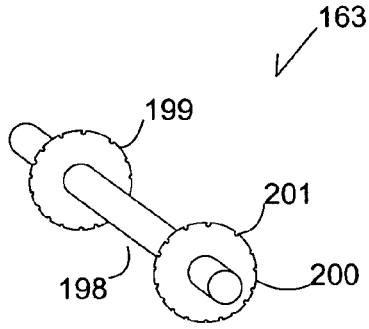
FIG. 1*m* provides a perspective view of a follower shaft assembly for the dispense buffer according to the preferred embodiment.

The dispense buffer 115 further includes a structural support at each axle assembly and a span support 212 disposed between the shaft assemblies. As shown in FIG. 1*k*, a first shaft support 210 support the drive axle assembly 162, and a second shaft support 211 secures the follower axle assembly 163. In this particular example, the first and second shaft supports 210-211 are formed from structural materials, such as stainless steel tubing.

The drive shaft assembly 162 includes a drive shaft 190, a first sprocket 191, and a second sprocket 192. The drive shaft 190 includes sprocket retention features, and a driver input feature for engaging the driver 164. In this particular example, the driver input feature is a spline, and the sprocket retention features are grooves for receiving e-rings. The first and second sprockets 191-192 include pin engagement features 196 disposed around a perimeter for engaging the pivot pins 181 keeping the belt segments 166 together. In this particular example, the spacing between the pivot pins 181 is approximately four inches, and a spacing between the pin engagement features 196 on the sprockets 191-192 is complementary to the pivot pin 181 spacing.

The follower shaft assembly 163 includes a follower shaft 198, and first and second sprockets 199-200. The follower shaft 198 includes sprocket engagement features to adapt to the first and second sprockets 199-200, such that the sprockets 199-200 move with the follower shaft 198. The follower shaft 198 further includes sprocket retention features, in similar fashion to the drive shaft 190, whereby the first and second sprockets 199-200 are restrained at a predetermined spacing, and are identically timed, relative to each other. The first and second sprockets 199-200 include pin engagement features 201 disposed around a perimeter, as described in the disclosure for the drive shaft assembly 162.

The driver 164 is virtually any form of torque delivery device, dependent upon the torque requirements. In this particular example, the driver 164 is an electric motor. The driver 164 may further include a drive shaft engagement feature adaptable to the drive shaft 190.

The dispense buffer 115 may further include at least one sensor pair 203*a*-203*b* to discern the presence of a filled product receptacle 119 disposed within one, or all, of the dispense buffer slots. As shown in FIG. 1*k*, the sensor 203*a* is an emitter, and sensor 203*b* is a detector, whereby the sensor 203*b* detects a beam output by the sensor 203*a*.

The product dispenser 100 may further include a controller 202. In this disclosure, the term "controller" is defined as virtually any form of processing device, such as a CPU that is able to electronically communicate with any control components, including sensors, refrigeration decks, drivers, and the like. In this particular example, the controller 202 is disposed in a control unit 102, and can communicate electronically with control components, motors, sensors, circuit boards, climate control systems, and the like. The control unit 102 further includes internet communications, and cellular phone communications, whereby an owner may communicate with the product dispenser 100 for update, fault codes, and the like.

Figure 2B:
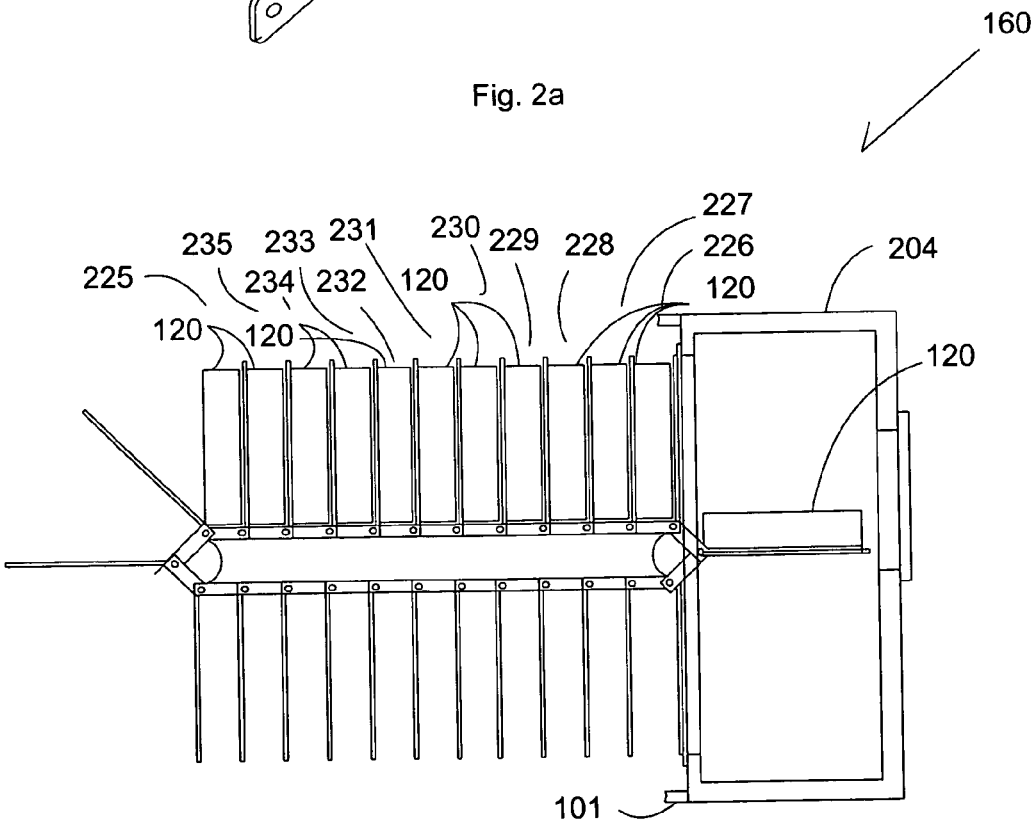
FIG. 2*b* provides a section view illustrating the sealing relationship between the belt segments and the outlet port according to the preferred embodiment.

The product dispenser 100 may further include an airlock 204 attachable to the shell 106, whereby the airlock 204 defines an airlock chamber 205. The airlock 204 attaches to the shell 106, such that the outlet port 113 of the shell 106 feeds into the airlock chamber 205. The airlock 204 is of a reduced volume sufficient to allow the single product receptacle 120 disposed within the first dispense buffer slot 226 to be rotated to a level position for dispensing, while minimizing conditioned air loss. As shown in FIG. 1*n* and 2*b*, the airlock 204 further includes an airlock outlet 206. The airlock 204 may be formed from virtually the same materials as the shell 106, whereby the airlock 204 has low thermal conductivity properties. The airlock outlet 206 further includes an airlock closeout 207 to minimize the movement of cold air out of the airlock 206 and the shell 106. In this particular example, the airlock closeout 207 is an insulated door. While this embodiment has been shown with an airlock 204 of a preselected volume, one of ordinary skill in the art will recognize that other airlock volumes are possible, and, therefore, should be construed as being within the scope of this invention.

Figure 2C:
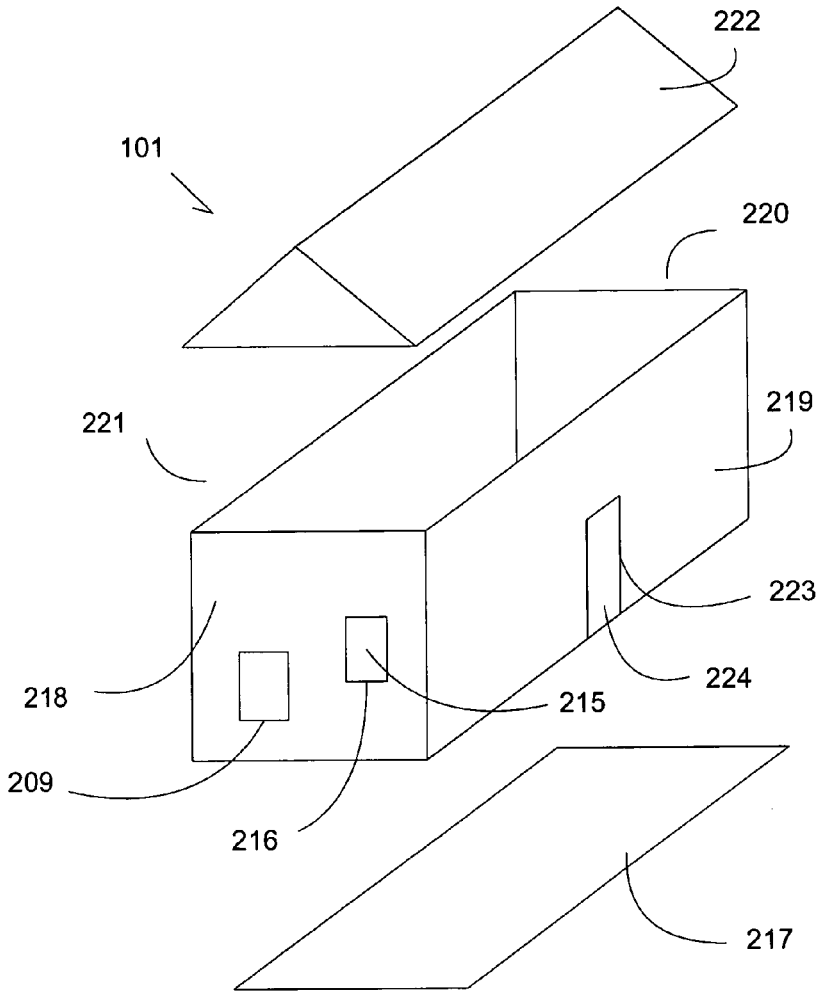
FIG. 2*c* provides an exploded view of the outer housing according to the preferred embodiment.
Figure 2D:
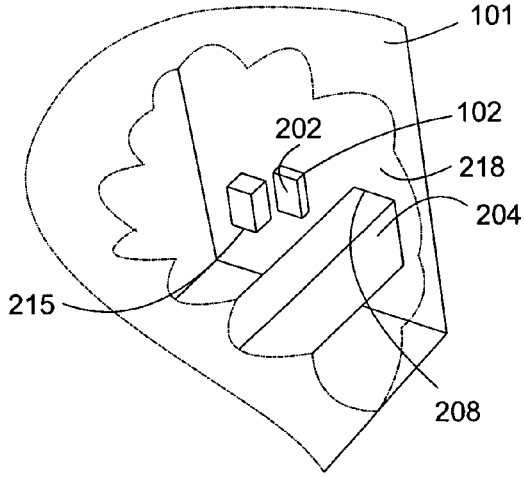
FIG. 2*d* provides a cutaway view of the outer housing according to the preferred embodiment.

The product dispenser 100 further includes an outer housing 101 to protect the shell 106, and all components disposed within the shell 106. The outer housing 101 may be constructed from structural materials, including sheet metal panels in combination with urethane foams, whereby the panels provide additional thermal protection. As shown in FIG. 2*c*, the outer housing includes first through fourth walls 218-221, a flooring assembly 217, and a roofing assembly 222, whereby the product dispenser 100 may be delivered and connected as a stand-alone unit. The airlock 204 may share a wall with the outer housing 101, whereby the airlock outlet 206 is disposed within the wall of the outer housing 101. As shown in FIGS. 2*c*-2*d*, the first wall 218 is an interface wall that houses a vend interface unit 215 in a vend interface port 216, as well as the airlock outlet 206. The vend interface unit 215 includes a vend interface panel that allows customers to purchase product or place a demand recognizable by the controller 202. Accordingly, the airlock 204 bridges the gap between the outlet port 113 of the shell 106 and the outer housing 101.

In this disclosure, the term "vend interface" includes the receipt of monetary units, and may interface with the controller 202 to regulate the receipt of monetary units, processing of the monetary units, as well as the delivery of product in response to the monetary units.

On assembly, the flooring assembly 217 of the outer housing 101 is constructed first to provide structural support for all of the remaining components. Flooring panels include insulation to ease a buildup of the shell 106 on top of the flooring assembly 217. Flooring panels may be joined together on a common frame utilizing connection features disposed within the panels, such as overlapping portions, tongue and groove connections, overlap panels in combination with a screw gun, and the like. Next, vertical panels may be secured around the flooring assembly 217 to create a box shape. One of the panels may include a door feature 223, whereby the workers may transit to an inner portion of the assembly to further secure the structure. The outer housing 101 may further include an airlock port 209 for receiving the airlock outlet 206.

On further assembly, the roofing assembly 222 may be installed to close out the outer housing 101. As the outer housing 101 is formed from materials that are weather resistant, the product dispenser 100 may be placed as a standalone unit, without compromising any components disposed within the outer housing 101.

Buildup of the shell 106 is desirable to define the outlet port 113 and the inlet port 112. Once the outlet port 113 is defined, the closeout device 118 may be installed. In this particular example, the closeout device 118 consists of two components that mate to each other to form a seal. Illustratively, as shown in FIGS. 2*a*-2*b*, the outlet port seal 116 and the seal flange 171 come together to closeout the outlet port 113 and the rear supports 168 of the saddle 165 nearest the outlet port 113. As such, product receptacles 120 pass from the product dispensing chamber 110 to the airlock 204 through the outlet port 113. Accordingly, the outlet port 113 only allows the transmission of conditioned air into the airlock 204 during conveyor 161 movement.

Next, the airlock 204 is secured to the outlet port 113 and the airlock port 209 in the outer housing 101 to separate the airlock 204 from the chamber of the outer housing 101. In this particular example, the airlock 204 bridges the gap between the outlet port 113 of the shell 106 and the airlock outlet 206. With the airlock 204 in place, an object moving though the outlet port 113 enters the airlock 204, and must exit the airlock outlet 206. With the airlock 204 in place, the airlock closeout 207 may be installed to keep air disposed within the airlock chamber 205 from escaping, unless the airlock closeout 207 is opened by a consumer when retrieving a purchased filled product receptacle 119. In this particular example, the airlock closeout 207 is an insulated door. The airlock closeout 207 may further include a locking device 208, whereby the controller 202 must unlock the locking device 208 during a vending sequence for retrieval of the filled product receptacle 119.

Next, the vend interface unit 215 may be installed into the vend interface port 216, whereby consumers may approach the product dispenser 100 and interact with the vend interface unit 215 to purchase or register a demand for product. The control unit 102 may be disposed inside of the outer housing 101 and in close proximity to the vend interface unit 215.

Assembly of the support frame for the dispense buffer 115 includes welding of the first and second shaft supports 210-211, installation of bearings for holding the rotating shafts, and a mount for the driver 164. Next, the span support 212 may be connected to the first and second shaft supports 210-211 at a predetermined height to adequately support the conveyor belt 161 between the first and second shaft supports 210-211. In this particular example, the support frame is formed from structural members. The support frame may further include first through third bearings to receive a shaft end. The span support 212 is disposed at a predetermined height, such that the bag engagement faces 167 of the saddle 165 are at a same height, or slightly lower than, the level of the scale 135 in the non-weighing position. The sensor pair 203*a*-203*b* is disposed at a predetermined height, such that the beam is broken with the presence of a product receptacle 120 within one or more of the dispense buffer slots 226-235.

Assembly of the belt segments 166 is accomplished by securing the links 169-170 to the first and second flanges 178-179 of the saddle 165. The primary faces 174 are spot-welded to the saddle 165, whereby the first and second links 169-170 are disposed symmetrically, and the secondary faces 173 are closer to each other than the primary faces 174. Next, the seal flange 171 must be secured to the rear support 168. Upon assembly, the belt segments 166 may be oriented in a line by aligning the first pivot apertures 176 of a first belt segment 166 with the second pivot apertures 177 of a second belt segment 166.

Figure 2E:
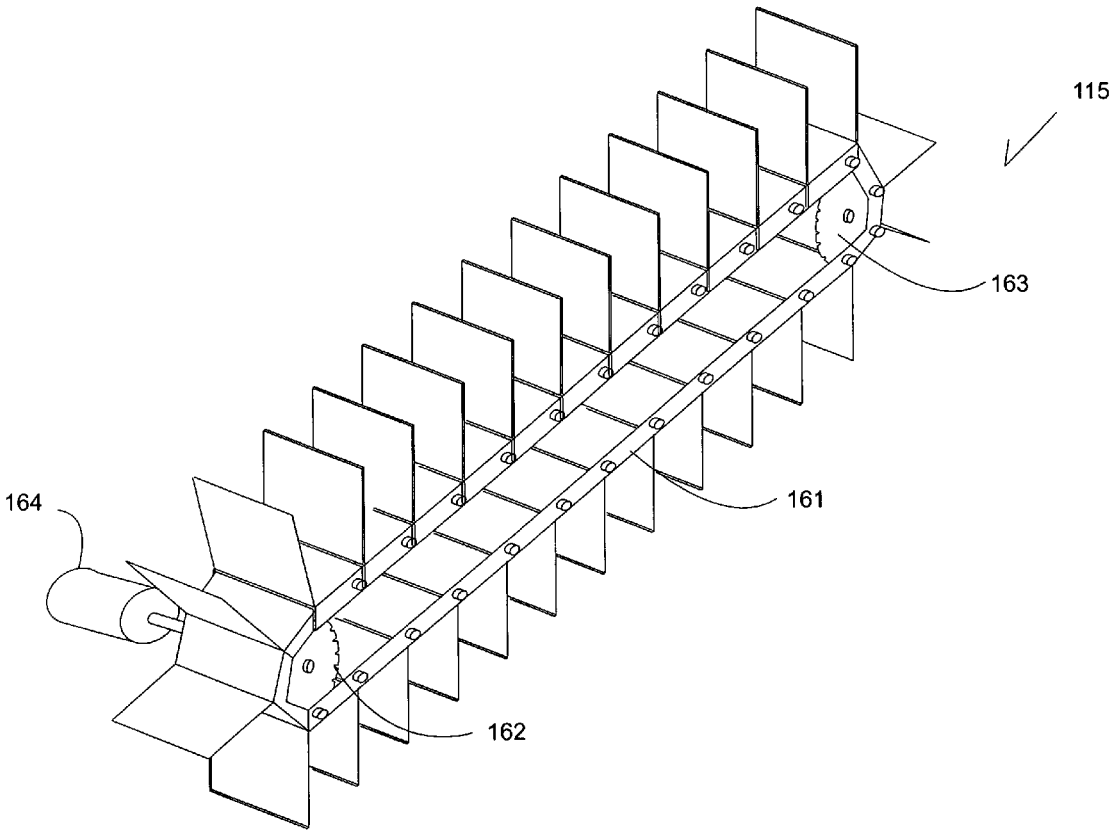
FIG. 2*e* provides a perspective view of the dispense buffer according to the preferred embodiment.
Figure 2F:
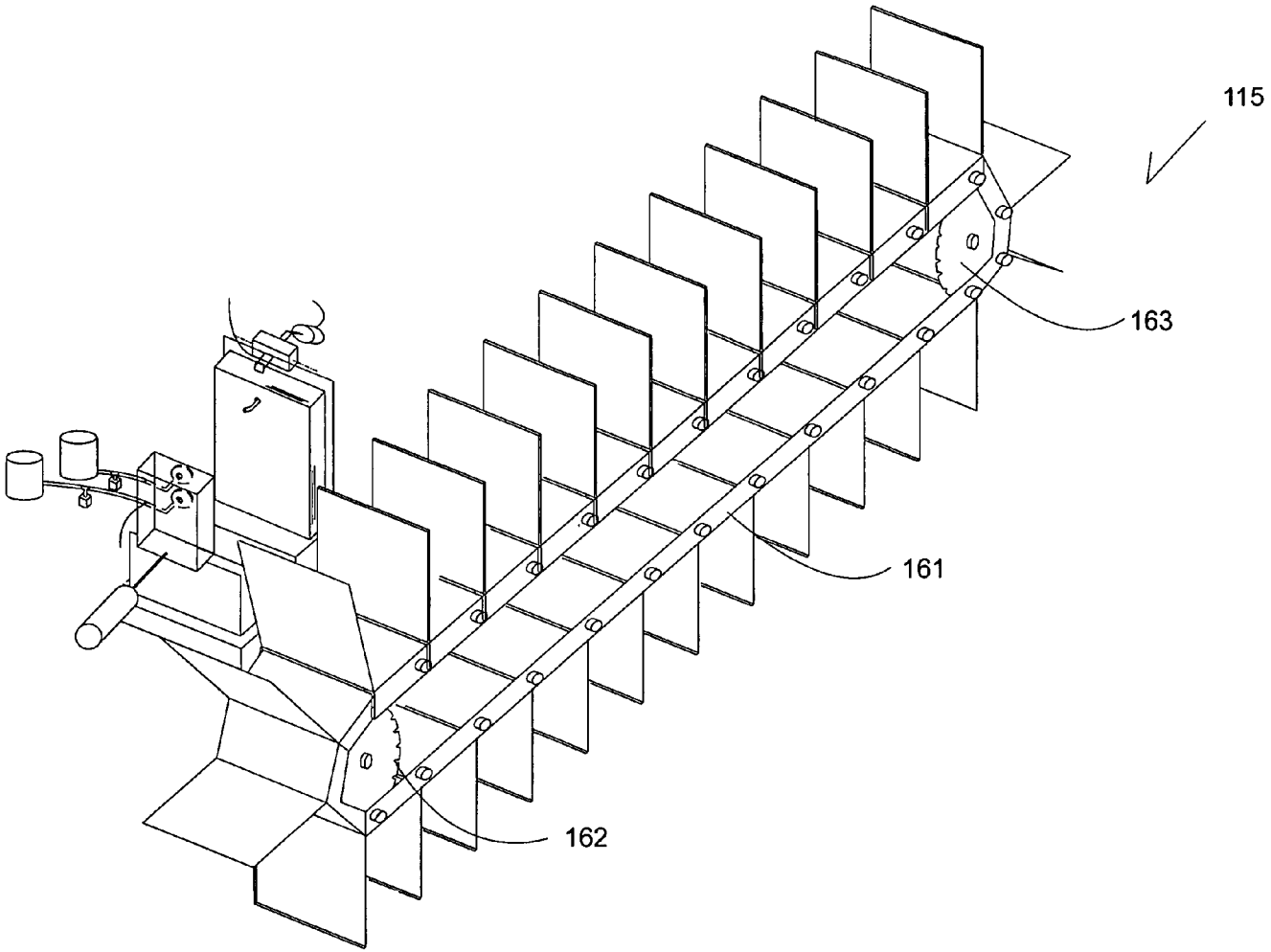
FIG. 2*f* provides a perspective view of the portioning station and the dispense buffer in an assembled form according to the preferred embodiment.

Next, the body 182 of a pivot pin 181 is inserted into the pivot apertures 176-177 and a pin retainer 187 is installed onto the pin restraint feature 185 to restrain the pivot pin 181 in place. Additional belt segments 166 may then be added to further lengthen the conveyor belt 161. Upon achieving a desired length, the shaft assemblies 162-163 may be secured to the conveyor framework and the pins 181 of the conveyor belt 161 may be keyed into the pin engagement features 196, and then the final pivot pin 181 may be inserted to complete the loop. As shown in FIG. 2*e*, the conveyor belt 161 may rotate with the sprockets 191-192 and 199-200 of the shaft assemblies 162-163.

Once the conveyor belt 161 is assembled, the dispense buffer 115 may be installed into the product dispense chamber 110, such that the first dispense buffer slot 226 is disposed adjacent to the outlet port 113 of the shell 106, and the seal flange 171 disposed on the rear support 167 mates with the outlet port seal 116 to close out the outlet port 113, thereby halting the loss of conditioned air through the outlet port 113.

Upon full assembly of the conveyor belt 161, the dispense buffer 115 includes a loading slot 225, and first through tenth dispense buffer slots 226-235. As shown in FIG. 2*b*, the loading slot 225 is disposed furthest away from the outlet port 113, and the first dispense buffer slot 226 is disposed adjacent to the outlet port 113. The first through tenth dispense buffer slots 226-235 are disposed in ascending order starting with the first buffer dispense slot 226, and are all disposed between the outlet port 113 and the loading slot 225. The first buffer dispense slot 226 is assigned a highest priority, the second buffer dispense slot 227 is assigned a next highest priority, and the remaining buffer dispenser slots are similarly assigned a next highest priority.

Next, the scale 135 and the scale lock 137 are adapted to the scale support frame 136. The build of the portioning station 114 continues with the first and second width guide plates 152-153, whereby the guide plates 152-153 extend upward from the scale support frame 136.

The ejection apparatus 132 may then be attached to the scale support frame 136, such that the pushbar driver 156 is disposed at a same level as the scale support frame 136, and the push bar driver 156 extends over the scale 135 and between the first and second width guide plates 152-153. Accordingly, the pushbar 155 must fit between the first and second width guide plates 152-153, and must retract to a point that does not interfere with feeding of the product receptacles to the portioning station 114.

Next, the staging apparatus 133 is mounted to an upper portion of the first width guide plate 152 using any suitable form fasteners, such as bolts, screws, or the like. The support plate 149 is mounted such that the hanger bracket 127 is disposed above and slightly offset from the scale 135. In this fashion, a plurality of product receptacles 120 may be stored on the hanger bracket 127 within the offset 154 of the support plate 149, and not interfere with opening operations.

The opening apparatus 131 may then be installed. The restraint device 139 is then mounted to the support plate 149, such that the base portion 145 is disposed above the hanger bracket 127 and the base portion 145 is disposed horizontally in a first position and is angled toward the scale 135 in a second position. The second driver 147 may then be secured to the scale support plate 149 and the base plate 145.

The buildup continues with the installation of the first and second vacuum sources 275-276. Next, the outlet ports 302 of the suction aids 298-299 are inserted into the first and second ports 294 and 295 of the vacuum block 279. The vacuum block 279 is then attached to the driver 287, and the driver 287 is then adapted to the scale support frame 136 through the use of standard mounting hardware. The vacuum lines of the first vacuum circuit 277 are now installed to pneumatically connect the first vacuum source 275 the first suction passage 291 of the vacuum block 279, and the first sensor 283 is inserted between the two. The first sensor 283 is in electrical communication with the controller 202.

In similar fashion, the second vacuum circuit 278 is assembled to pneumatically connect the second vacuum source 276, the second sensor 284, and the second suction passage 292 of the vacuum block 279, as well as the second vacuum aid 299. In this fashion, the opening apparatus 131 includes two vacuum circuits that may be commenced and halted by the controller 202.

The sealing apparatus 134 may then be assembled. As shown in FIG. 1*e*, the seal bar 239 may be attached to the heat seal driver 238, and the heat seal driver 238 may be attached to the heat seal structure 237. Next, the seal backup bar 240 may be connected to the seal bar structure 237, and the seal bar structure 237 may be attached to the position driver 241. The sealing apparatus 134 may then be installed above the ejection apparatus 132. The position driver 241 secures to the scale support frame 136 to register the seal bar 239 slightly below the suction support frame 140, and retracted from the portioning station 114.

After the sealing apparatus 134 is installed, the remaining panels of the shell 106 may be installed to close out the shell 106, thereby forming the product dispensing chamber 110. The outlet 107 of the product generator 105 may then be inserted into the inlet port 112 of the shell 106. In this configuration, the product generator 105 is disposed outside of the shell 106, but within the outer housing 101, thereby diverting heat loads from the product generator 105 away from the product disposed within the product dispensing chamber 110. The environmental control system 108 may then be installed into the environmental control port 117 disposed within the shell 106.

Next, the control unit 102 may be installed into the outer housing 101, a door 224 may be installed into the door feature 223, and the vend interface unit 215 may be installed into the vend interface port 216, thereby closing out the first through fourth walls 218-221 of the outer housing 101.

The roofing assembly 222 is then installed onto the first through fourth walls 218-221 to close out the outer housing 101, thereby providing protection to the shell 106.

On full assembly, the product dispenser 100 includes a staging area, an opening apparatus 131, a portioning station 114, a sealing apparatus 134, an ejection apparatus 132, and a dispense buffer 115 that houses a bank 128 of storage slots, as well as a controller 202 to manage the production of filled product receptacles 119, the storage of the filled product receptacles 119 in the dispense buffer slots 226-235, and a dispensing of a single filled product receptacle 119 in response to a demand generated by a purchaser. The bank 128 of storage slots 226-235 carry different priorities, and, accordingly, the controller 202 must fill or dispense a highest priority storage slot. A highest priority slot for dispensing is the one disposed adjacent to the outlet port 113, and a highest priority slot for storage is the unfilled slot furthest from the loading slot 225. The controller 202 must further discern between demands for storing and demands for dispensing. In this disclosure, the term internal demand is defined as a requirement to fill one of the dispense buffer slots, and the term external demand is defined as a requirement to dispense a filled product receptacle 119 that is stored within one of the dispense buffer slots to the airlock 204. As such, the controller 202 operates to fill all of the storage slots 226-235 in the dispense buffer 115, and keep them filled. Upon an external demand at the vend interface unit 215, the controller 202 dispenses a filled product receptacle 119 to the airlock 204, and the purchaser opens the airlock closeout 207 to access the newly dispensed filed product receptacle 119. Once the filled product receptacle 119 is dispensed, the emptied dispense buffer slot creates an internal demand, and the controller 202 creates an additional filled product receptacle 119 to be placed into the highest priority storage slot available.

A product receptacle path 103 is created for the empty product receptacles 120, as follows: hanging from the hanger bracket 127 in the staging area; being grabbed by the vacuum aids 298-299 and pulled toward the driver 287 while being restrained by the restraint bar 141, thereby opening the product receptacle 120 for filling. After opening, the product receptacle 120 is filled with the product entering through the inlet port 112 of the shell 106 and portioned by the metering apparatus 130. Next, the product receptacle 120 is sealed by the sealing apparatus 134.

Once the product receptacle 120 is filled, the product receptacle 120 and product move together through a product path 104. The product path 104 for a filled product receptacle 119 is defined as follows: being moved from the scale 135 to the loading slot 225 of the dispense buffer 115 by the ejection apparatus 132; being moved to a highest priority dispense buffer 115 storage slot; being moved through the outlet port 113 to the airlock 204 upon a dispense command for retrieval by a purchaser, whereby the purchaser retrieves the filled product receptacle 119 through the airlock outlet 206.

Figure 3A:
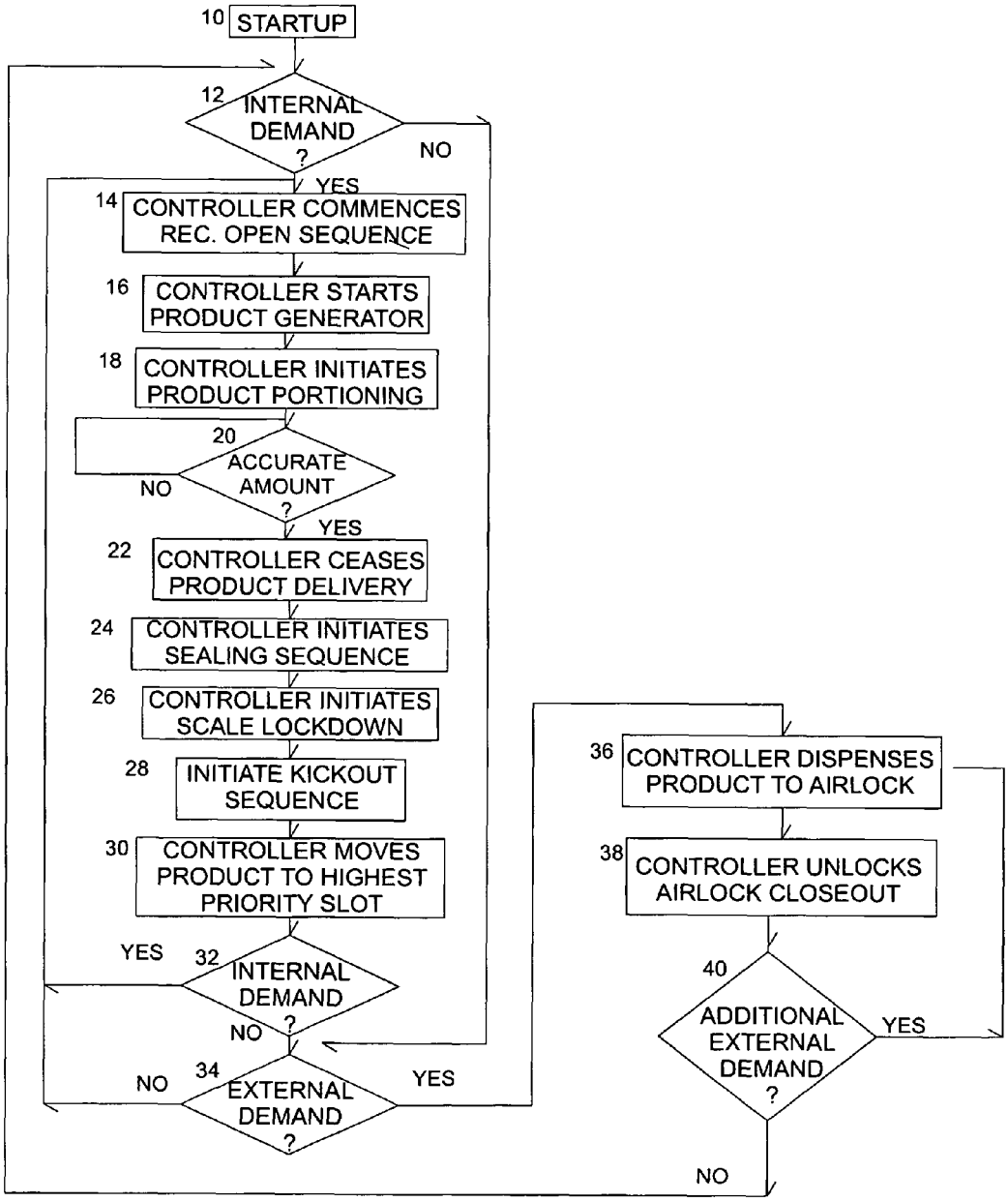
FIG. 3*a* provides a method flowchart illustrating the method steps for keeping the dispense buffer filled according to the preferred embodiment.

Before startup, a stack 151 of empty product receptacles 120 must be placed into the staging location and hung on the hanger bracket 127. As shown in the method flowchart of FIG. 3*a*, an operational sequence commences with step 10, wherein the product dispenser 100 is started. The controller 202 must then determine if an internal demand exists, step 12. If an internal demand exists, the controller 202 moves to step 14, and commences a bag open sequence, as described in the method flowchart of FIG. 3*b*. Next, the controller 202 initiates a product source 111 production sequence to commence filling of the opened product receptacle 120, step 16. After commencing the production sequence, the controller 202 commences the product portioning sequence to weigh the product disposed within the opened product receptacle 120, step 18. In step 20, the controller 202 determines if the predetermined weight has been achieved. If the predetermined weight has not been achieved, the controller 202 returns to step 20 for reassessment. If the predetermined weight has been achieved in step 20, the controller 202 ceases the product source 111 production sequence, step 22.

Upon a proper weight, the controller 202 initiates a sealing sequence to seal the properly filled product receptacle 120, step 24. Upon sealing, the controller 202 initiates a scale lock-down sequence, whereby the scale 135 moves to be level with the scale frame 136, step 26. Upon scale 135 lock-down, the controller 202 initiates a kickout sequence, whereby the filled product receptacle 119 is pushed off of the scale 135 and onto the loading slot 225 of the dispense buffer 115, step 28. The controller 104 then moves the filled product receptacle 119 to a highest priority dispense buffer slot for storage, step 30. In step 32, the controller 202 determines if an internal demand still exists. If an internal demand still exists in step 32, the controller 202 returns to step 14 to recommence production of a filled product receptacle 119. If an internal demand does not exist in step 32, the controller 202 moves to step 34 to determine if an external demand exists.

If an internal demand does not exist in step 12, the controller 202 moves to step 34 to determine if an external demand exists.

If an external demand exists in step 34, the controller 202 moves to step 36 to commence a dispense sequence, whereby the conveyor 161 rotates to move the highest priority filled product receptacle 119 stored in a dispense buffer slot through the outlet port 113 and into the airlock 204. If an external demand does not exist in step 34, the controller 202 returns to step 14. In step 38, the controller 202 unlocks the airlock closeout 207, such that a consumer may access the airlock 204 and retrieve their filled product receptacle 119. In step 40, the controller 202 determines if an additional external demand exists. If an additional external demand exists in step 40, the controller 202 returns to step 36 to execute an additional dispense sequence. If an additional external demand does not exist in step 40, the controller 202 returns to step 12 to reassess if an internal demand is now present.

Figure 3B:
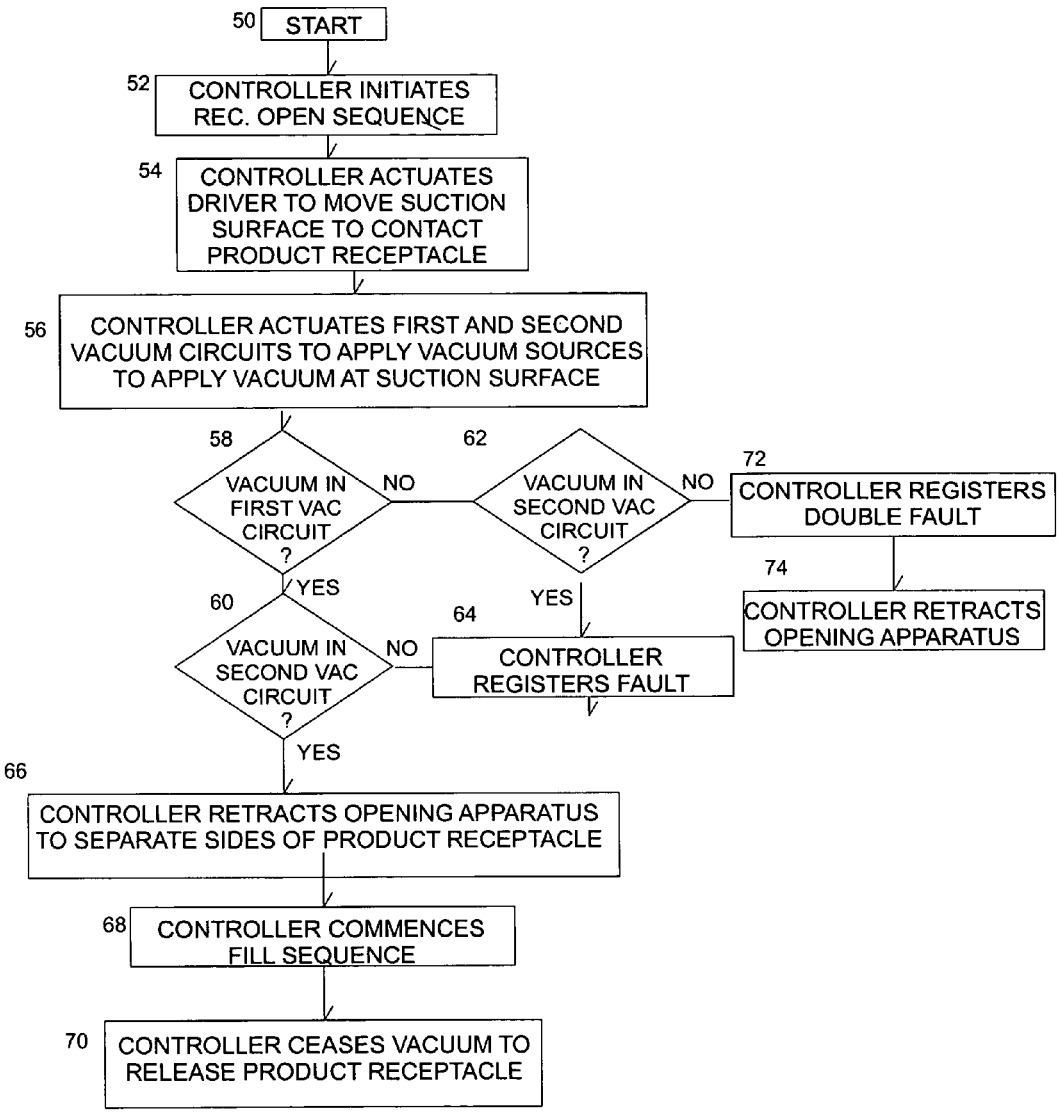
FIG. 3*b* provides a method flowchart illustrating the method steps for opening the product receptacle according to the preferred embodiment.

The controller 202 initiates a product receptacle open sequence to pull the first side and the second side of the product receptacle 120 apart. As shown in FIG. 3*b*, the process commences with step 52, wherein the controller initiates the product receptacle open sequence. In step 54, the controller 202 actuates the driver to move the suction surface into contact with the second side of the product receptacle 120. The process then moves to 56, wherein the controller 202 actuates the first and second vacuum circuits, thereby applying vacuum at the suction surface. The controller 202 then moves to step 58 to determine if a predetermined level of vacuum exists in the first vacuum circuit. If a predetermined level of vacuum exists in step 58, then the controller 202 moves to step 60 to determine if a predetermined level of vacuum exists in the second vacuum circuit. If a predetermined level of vacuum exists in step 60, the controller moves to step 66, wherein the controller retracts the opening apparatus to separate the sides of the product receptacle 120. The controller 202 then moves to step 68, wherein the controller 202 commences the fill sequence. Upon filling to a predetermined level, the controller 202 moves to step 70, wherein the controller 202 ceases the generating vacuum to release the product receptacle.

If a predetermined level of vacuum does not exist in step 58, the controller moves to step 62, wherein the controller determines if a predetermined level of vacuum is present in the second vacuum circuit. If a predetermined level of vacuum does not exist in step 62, the controller moves to step 72, wherein the controlled registers a double fault. After registering the double fault, the controller moves to step 74 and retract the opening apparatus.

If a predetermined level of vacuum exists in step 62, the controller moves to step 64 to register a fault.

If a predetermined level of vacuum does not exist in the second vacuum circuit in step 60, the controller moves to step 64 to register a fault.

Accordingly, the controller 202 may track the faults over time, and may issue a fault notification to an owner through a message in a display, a phone call, e-mail, or the like. As the product dispenser 100 is a remote unit, the ability to be informed of the product dispenser performance is key.

Figure 3C:
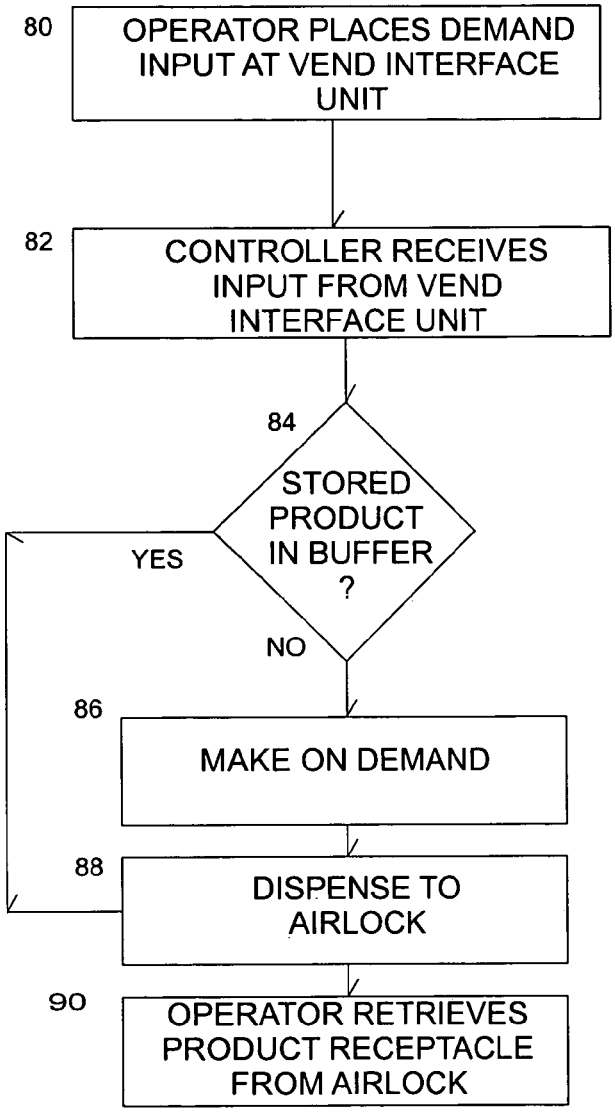
FIG. 3*c* provides a method flowchart illustrating the use of the product dispenser by a consumer according to the preferred embodiment.

In use, an operator approaches the product dispenser 100 to place an external demand on the product dispenser 100. As shown in the method flowchart of FIG. 3*c*, the operator places an external demand at the vend interface unit by inserting monetary components or inserting a credit card, step 80. Next, the controller 202 registers external demand from the vend interface unit, step 82. In step 84, the controller 202 determines if a portioned product receptacle 120 is stored in the dispense buffer 115. If a portioned product receptacle 120 is not stored in the dispense buffer 115 in step 84, the controller 202 moves to step 86 and creates a filled product receptacle 119 on demand. Next the controller 202 moves to step 88, wherein the controller 202 dispenses the newly formed portioned product receptacle 119 to the airlock. In step 90, the operator retrieves the filled product receptacle 119 from the airlock 204.

If a stored filled product receptacle 119 exists in step 84, the controller 202 moves to step 88, wherein the stored filled product receptacle 119 is dispensed to the airlock 204.

While this embodiment has been shown with product receptacle 120 that is filled and sealed, the intent of this invention is to provide a portioned product package that may be sealed in cases of products that are required to be sanitary, or may be left unsealed in cases where the product is shelf stable, not consumed, or the like. One of ordinary skill in the art will recognize that the type of product dictates the type of handling.

In an extension of the first embodiment, a product dispenser 250 is similar in construction to the product dispenser 100, however, the product dispenser 250 further includes a second bank of dispense buffer slots, thereby increasing a total storage capacity of the dispense buffer, as well as the product dispenser 250. All other aspects and components of the product dispenser 100 are identical, and, accordingly, have been referenced with like numerals.

Figure 4A:
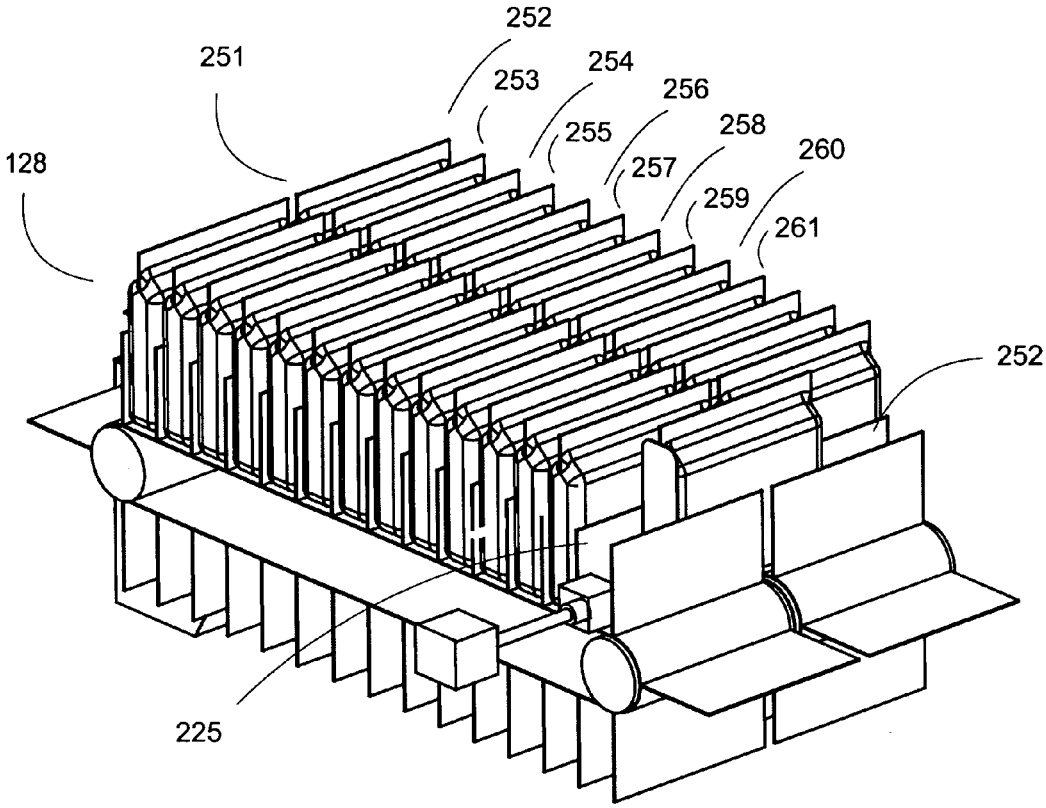
FIG. 4*a* provides a perspective view of product dispenser having an additional dispense buffer bank according to a second embodiment.

As shown in FIG. 4*a*, the product dispenser 250 includes a first bank 128 as described in the simplest embodiment, a second bank 251 having first through tenth dispense buffer slots 253-261, and a second bank loading slot 252.

Figure 4B:
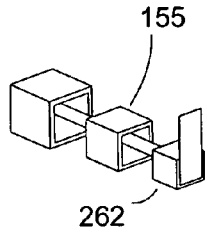
FIG. 4*b* illustrates a dual bank ejection device according to the second embodiment.

The product dispenser 250 further includes a two stage ejection device that delivers to the loading slot 225 and the second bank loading slot 252, as required. As shown in FIG. 4*b*, a dual stage pushbar 262 is disposed in the pushbar 155 of the first embodiment. As such, the controller 202 may move the filled product receptacle 119 to the first bank loading slot 225 by actuating the first stage pushbar 155, or the controller 202 may actuate the first stage pushbar 155 and then the second stage pushbar 262 to move the filled product receptacle 119 to the second bank loading slot 252.

The first and second banks 128 and 251 are substantially identical, and, therefore, storage slots carry a same priority scheme as described in the first embodiment. However, the banks 128 and 251 are weighted differently, with the first bank 128 carrying a higher priority than the second bank 251. Accordingly, the controller 202 will fill the storage slots in the first bank 128 first, and then fill the storage slots 253-261 of the second bank 251.

All other aspects of this extension of the first embodiment are identical to the first embodiment, and, therefore, will not be further described.

While this invention has been shown with the product dispenser being an self contained walkup version having a vend interface unit, one of ordinary skill in the art will recognize that the product dispenser may be scaled down in size, and placed inside of a structure, such as a grocery store, to dispense a single product receptacle at a time, wherein a consumer may place a demand at the vend interface unit of the product dispenser. Dependent upon the type of store and the volume, a store may issue tokens, or the vend interface unit may not require monetary units for dispensing.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A product dispenser, comprising:

a shell defining a product dispensing chamber, wherein the product dispensing chamber is environmentally controlled;

an inlet port disposed within the shell, wherein the inlet port is in communication with a product source, whereby the product source delivers a product into the product dispensing chamber through the inlet port;

a portioning station disposed within the product dispensing chamber, wherein the portioning station houses at least one product receptacle having a receiving chamber for receiving the product, and further wherein a predetermined amount of the product is dispensed into the receiving chamber of the at least one first product receptacle, thereby creating a portioned product receptacle;

a sealing apparatus disposed at the portioning station, wherein the portioned product receptacle is sealed after the portioning;

a dispense buffer disposed within the product dispensing chamber, wherein the dispense buffer comprises a conveyor bank comprising:

a receiving slot position disposed on a conveyor, wherein the dispense buffer receives the portioned product receptacle from the portioning station at the receiving slot; and at least one dispense buffer slot disposed on the conveyor bank, wherein the at least one dispense buffer slot to be filled moves backward to the receiving slot to receive the portioned product receptacle, and further wherein the conveyor is rotated forward to move the portioned product receptacle disposed at the receiving slot to the at least one dispense buffer slot for storing until an external demand is registered;

an ejection device disposed within the product dispensing chamber and in communication with the portioning station, wherein the ejection device extends from a first position to a second position to move the portioned product receptacle from the portioning station to the receiving slot of the dispense buffer; and an outlet port disposed within the shell, whereby the portioned product receptacle is dispensed through the outlet port when an external demand is registered.

2. The product dispenser according to claim 1, further comprising:

an airlock in communication with the outlet port, wherein the airlock includes an airlock outlet, whereby a consumer opens the airlock outlet to retrieve the portioned product receptacle after dispensing.

3. The product dispenser according to claim 1, wherein the portioning device weighs the product to portion.

4. The product dispenser according to claim 1, wherein product source is a product generator.

5. The product dispenser according to claim 4, wherein the product generator generates ice.

6. The product dispenser according to claim 5, wherein the ice is extruded ice.

7. The product dispenser according to claim 1, further comprising a vend interface unit for conducting vend operations, and receiving demands from consumers desiring a portioned product receptacle.

8. The product dispenser according to claim 6, further comprising:

a controller in electrical communication with the vend interface unit, wherein the controller registers the demand input from the vend interface unit and commences portioning operations for an internal demand, and dispenses the at least one portioned product receptacle that is stored in the dispense buffer slot.

9. The product dispenser according to claim 1, wherein the climate control system is a freezer.

10. The product dispenser according to claim 1, wherein the shell is disposed within an outer housing.

11. The product dispenser according to claim 8, wherein the receiving slot is a position adjacent to the portioning station.

12. The product dispenser according to claim 11, wherein a controller actuates a driver to move the portioned product receptacle from the receiving slot to the at least one dispense buffer slot for storing.

13. The product dispenser according to claim 1, wherein additional dispense buffer slots may be added to the first bank by adding belt segments to the first conveyor bank.

14. The product dispenser according to claim 1, further comprising a second bank disposed adjacent to the first bank, wherein the second bank comprises:

a second receiving slot; and at least one dispense buffer slot.

15. The product dispenser according to claim 14, wherein the second receiving slot is disposed adjacent to the first receiving slot.

16. The product dispenser according to claim 15, wherein the ejection device comprises a third position to move the portioned product receptacle from the portioning station to the second receiving slot disposed in the second bank.

17. The product dispenser according to claim 8, wherein the controller keeps all of the at least one dispense buffer slots filled with portioned product receptacles in response to internal demands, thereby creating a buffer of portioned product receptacles dispensing in response to the external demands.

18. The product dispenser according to claim 13, wherein the belt segments comprise:

a saddle; and a rear support.

19. The product dispenser according to claim 18, wherein the rear support comprises a seal flange for closing out the outlet port of the shell.

* * * * *